US012134414B2

(12) United States Patent
Pieper et al.

(10) Patent No.: US 12,134,414 B2
(45) Date of Patent: Nov. 5, 2024

(54) AUTOMATIC SWITCH PLATE LUBRICATION ASSEMBLY

(71) Applicant: RBL, Inc., Minneapolis, MN (US)

(72) Inventors: Robert Gregory Pieper, Minnetonka, MN (US); Justin Jeong Dailey, Crystal, MN (US); Christian Robert Pieper, Shakopee, MN (US)

(73) Assignee: RBL, Inc., Minneapolis, MN (US)

( * ) Notice: Subject to any disclaimer, the term of this patent is extended or adjusted under 35 U.S.C. 154(b) by 0 days.

(21) Appl. No.: 18/201,634

(22) Filed: May 24, 2023

(65) Prior Publication Data

US 2023/0382441 A1 Nov. 30, 2023

Related U.S. Application Data

(60) Provisional application No. 63/345,755, filed on May 25, 2022.

(51) Int. Cl.
*B61K 3/00* (2006.01)

(52) U.S. Cl.
CPC ..... *B61K 3/00* (2013.01)

(58) Field of Classification Search
CPC ..... B61K 3/00
See application file for complete search history.

(56) References Cited

U.S. PATENT DOCUMENTS 1,954,990 A * 4/1934 Elmer ..... B61K 3/00 184/3.1
2,285,082 A * 6/1942 Bolt ..... B61K 3/00 184/3.1
3,059,724 A * 10/1962 Soule, Jr. ..... B61K 3/00 184/3.1
4,520,901 A * 6/1985 Borup ..... F16N 27/02 184/15.3
4,736,818 A * 4/1988 Wolfe ..... B60F 1/043 239/161
4,834,218 A * 5/1989 Dombroski ..... B61K 3/02 184/39.1
7,481,297 B1 * 1/2009 Leslie ..... B61K 3/00 222/394
7,513,335 B2 * 4/2009 Kumar ..... B61K 3/00 246/435 R
8,584,804 B2 * 11/2013 Holland ..... B61K 3/00 184/3.1

(Continued)

FOREIGN PATENT DOCUMENTS

WO WO-2018151590 A1 * 8/2018 ..... B61K 3/00

*Primary Examiner* — Michael A Riegelman
(74) *Attorney, Agent, or Firm* — Z. Peter Sawicki; Westman, Champlin & Koehler, P.A.

(57) ABSTRACT

A system and method for remotely lubricating a rail switch plate, the system comprising at least one lubricant distribution nozzle mounted proximate a rail switch arm such that when the rail switch arm is in a first position, the at least one lubricant distribution nozzle is positioned above and over the rail switch plate and wherein a lubricant supply vessel and pump therefor are positioned at a location spaced apart from the rail switch arm and wherein the lubricant supply vessel is fluidically connected to the at least one distribution nozzle for directing lubricant through the nozzle to the switch plate.

12 Claims, 8 Drawing Sheets

(56) References Cited

U.S. PATENT DOCUMENTS 9,016,436 B2 * 4/2015 Paluncic ..... B61K 3/00 184/3.1
9,561,809 B2 * 2/2017 Nelson ..... F16N 13/22
2002/0056592 A1 * 5/2002 Arens ..... B61K 3/00 184/3.1
2003/0010571 A1 * 1/2003 Kostelny-Vogts ..... B61K 3/00 184/3.1
2003/0141148 A1 * 7/2003 DiCarlo ..... B61K 3/00 184/3.1
2004/0031647 A1 * 2/2004 Leslie ..... B61K 3/00 184/3.1
2004/0050623 A1 * 3/2004 Urmson, Jr. ..... B61K 3/00 184/3.1
2004/0238281 A1 * 12/2004 Kumar ..... E01B 7/26 184/3.1
2006/0163004 A1 * 7/2006 Kumar ..... B61K 3/00 184/3.1
2008/0203735 A1 * 8/2008 Leslie ..... B61K 3/00 291/3
2009/0000869 A1 * 1/2009 Holland ..... B61K 3/00 184/3.1
2009/0050409 A1 * 2/2009 Wakamatsu ..... B61K 3/00 184/3.1
2009/0095570 A1 * 4/2009 Gunacker ..... B61K 3/00 184/3.1
2011/0061973 A1 * 3/2011 Iden ..... B61K 3/02 184/3.2
2014/0054113 A1 * 2/2014 Powell ..... B61K 3/00 184/3.1
2014/0060972 A1 * 3/2014 Appleby ..... B61K 3/00 184/3.1
2014/0339021 A1 * 11/2014 Mandera ..... B61K 3/00 184/3.1
2015/0034422 A1 * 2/2015 Nelson ..... F16N 13/22 184/3.1
2020/0017130 A1 * 1/2020 Pieper ..... B61K 3/00
2023/0382441 A1 * 11/2023 Pieper ..... B61K 3/00

* cited by examiner

AUTOMATIC SWITCH PLATE LUBRICATION ASSEMBLY

BACKGROUND

The present invention relates to the distribution of lubricant to switch plates on a section of railroad tracks through the use of a remote or automatic system, and more specifically to a lubricant delivery system for mounting to a switch rail or switch rail arm.

Generally lubricant, or grease, is applied to the rail at the switch plate manually, with a device such as typical garden sprayer or brush. This method piles large amounts of grease or lubricant toward the top of the rail. This method causes excessive use of grease or lubricant and human intervention.

This excess lubricant also covers the earthen area surrounding the rail section. As lubricant is applied now, a large amount is pumped in order to make sure the small area that needs lubrication is actually covered. This excess lubricant ends up not only coating the entire plate, but also the ground surrounding it. While there may occasionally be pads laid down to absorb some of this excess lubricant, much of the excess seeps into the ground and migrates. This has negative impacts on the environment. Considering that major portions of railroad are set away from city areas, the lubricant can migrate into the environment near the tracks. Negative effects on the environment are compounded when the plates need to be repeatedly lubricated over time. Reducing the amount of lubricant needed will not only save money, but can reduce, if not eliminate any negative impact on the environment.

SUMMARY

An aspect of the present disclosure relates to an automatic rail switch plate lubrication system comprising a power unit enclosure; and an applicator unit secured to a rail switch arm; wherein the applicator unit comprises: a nozzle bar extending a length of the applicator unit; a plurality of adjustable lubricant application blocks, each block comprising a nozzle and wherein the plurality of adjustable lubricant application blocks are spaced apart along the nozzle bar and positionally adjustable there along; and an exchange point for fluidically coupling to a lubricant delivery hose connected to a reservoir holding lubricant to the nozzle bar for delivery of the lubricant to the each of the plurality of adjustable lubricant application blocks, and wherein the nozzle bar is heated for distribution of heated lubricant to an exposed portion of the switch plate.

In one or more embodiments the applicator unit is mounted on a section of rail proximate the switch plate of the rail and wherein the power unit is spaced therefrom.

The plurality of lubricant application blocks are configured to store a metered volume of lubricant received from a grease pump until the lubricant is discharged from the nozzle of the lubricant application block.

An air solenoid valve corresponding to a nozzle on an exposed plate side of the switch and wherein the valves are actuated for lubrication is provided.

The power unit houses one or more of an air compressor, air tank, lubricant pump, lubricant reservoir, water pump, water heater and power source.

An air flow is provided with the lubricant delivered to and through the nozzles and is sufficient to clear debris off a top surface of the switch plate.

The nozzle bar further comprises integral hot water and return lines for heating the lubricant and/or the lubricant distribution blocks on the applicator unit.

The applicator unit further comprises a removable protective shield for the nozzle bar.

One or more temperature sensors for the power unit, enclosure, outside air, applicator air, lubricant or combinations thereof are provided.

A high pressure positive displacement pump delivers lubricant from the reservoir to one or more lubrication application blocks operably connected thereto via flexible hoses.

An air compressor delivers air from an air reservoir to the one or more lubricant application blocks operably connected thereto wherein the air is delivered to and through the nozzle with lubricant.

The system is an electrically controlled system comprising one or more rechargeable batteries for power.

Another aspect of the present disclosure relates to a method of automatically lubricating a rail switch plate, the method comprising securing one or more lubricant applicator assemblies to a rail switch arm wherein the lubricant applicator assemblies support one or more lubricant application blocks, each supporting a nozzle thereon; pumping lubricant from a reservoir spaced apart from the lubrication track assembly to at least one lubricant application block; and initiating distribution of lubricant from the one or more nozzles when the one or more nozzles are directed to an exposed surface of the switch plate.

Providing air flow from a reservoir spaced apart from the lubricant applicator assemblies to the nozzles and pushing lubricant through the nozzle with air flow allows for lubricating and/or clearing the switch plate of debris.

Heating one or both of the lubricant applicator assemblies and lubricant reservoir allows for cold weather lubrication of the switch plate.

The method further comprises controlling initiating distribution of lubricant based on a position of the rail switch arm.

Installing electric power and control components, a pump and a lubricant storage reservoir in a power unit positioned at a location spaced apart from the lubricant applicator assembly allows for clear access to the switch plate.

Yet another aspect of the present disclosure relates to a system for remotely and automatically lubricating a rail switch plate, the system comprising at least one lubricant application nozzle mounted proximate a rail switch arm such that when the rail switch arm is in a first position, the at least one lubricant application nozzle is positioned above and over the rail switch plate and wherein a lubricant supply vessel and pump therefor are positioned at a location spaced apart from the rail switch arm and wherein the lubricant supply vessel is fluidically connected to the at least one application nozzle for directing lubricant through the nozzle to the switch plate.

The system further comprises an air compressor and air supply positioned at the location spaced apart from the rail switch arm and wherein the air supply is operably connected to the application nozzle for directing air and lubricant through the nozzle.

At least one application nozzle is positioned on a heated nozzle bar for delivering lubricant at a temperature sufficient to retain the lubricant in a flowable and/or atomized state for distribution through the nozzle.

DETAILED DESCRIPTION

Figure 2:
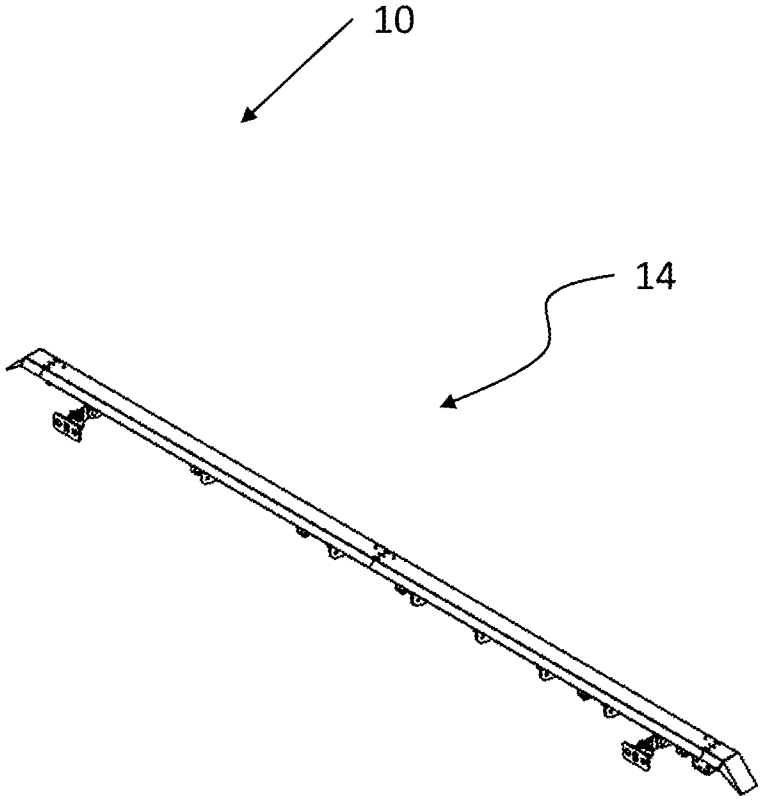
FIG. 2 is a front perspective view of an applicator unit for the lubrication system.
Figure 1:
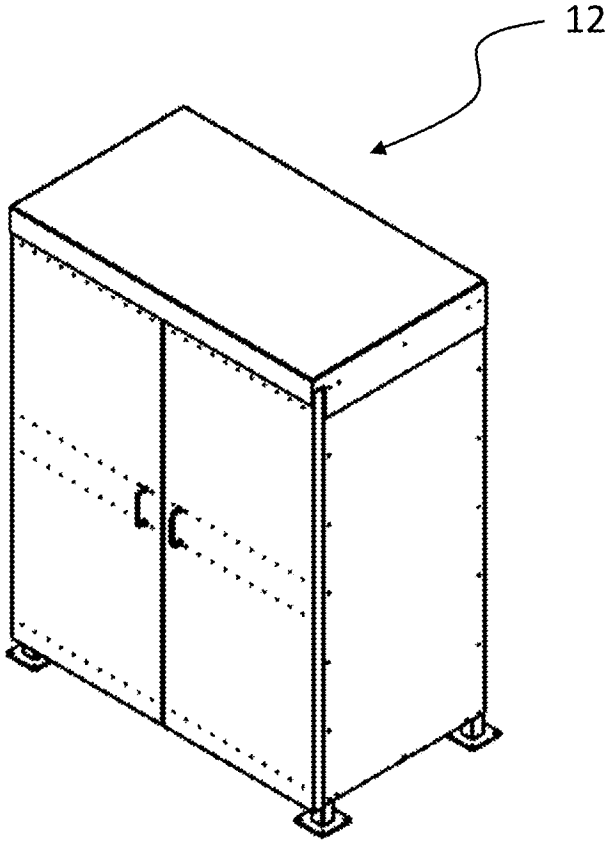
FIG. 1 is a front perspective view of a power unit for a lubrication system.

This disclosure relates to the application of lubrication to only a limited portion of rail where lubrication is actually needed. Large amounts of lubrication and money will be saved by applying a limited amount of lubricant to a directed or targeted location and at a more precise time with respect to the number of switch transitions. The lubrication application described herein also reduces friction between wheels and rails for safety and ensures a complete switch transition. If the switch transition is incomplete, derailment can occur.

In one or more embodiments, the system is an automatic switch plate lubricator that is a wayside machine that dispenses lubricant or "grease" when activated to maintain required lubrication level of train track switch plates and minimize friction between switch plates and the rail that slides across them. The device may be powered by LP, LNG, AC source, and/or other renewable energy sources.

The system is an automatic lubrication system using nozzles for delivery of lubricant is described herein. The nozzles are positioned over the switch plates at a switch along a section of rail and thus automatically deliver lubricant to the switch plate. The lubrication system generally comprises a power unit which is mounted near the section of rail road track with the switch and is operably connected to an applicator unit, also referred to as a lubrication track assembly which is mounted on the rail switch arm. When the switch arm is in a position over one or more switch plates, lubrication can be initiated. Thus, the automatic lubricant application may be initiated depending on the position of the switch arm. The lubrication track assembly comprises one or more lubricant delivery nozzles that are spaced apart along the track such that when the track assembly is installed on the rail switch arm the nozzles are aligned over the switch plates.

In one embodiment, the applicator unit or lubricant track assembly is mounted to or on a switch rail or switch rail arm and the power unit may be positioned in a location near the rail and installed track assembly but spaced therefrom. For example, the power unit may be located adjacent to the section of rail with the switch.

The power unit and applicator unit are connected by flexible hoses or pipes and cables for power control and delivery of lubricant from a reservoir in the power unit to a nozzle on the track assembly.

In one or more embodiments, the system is configured to automatically dispense heated grease onto exposed portion(s) of a switch plate with the intention of the sliding rail spreading the applied grease across the top of the plate and onto the base of the stationary rails when transitioned from a first position (position A) to a second position (position B) or from position B to position A. The grease or lubricant may be heated at one or more points between the reservoir storing a supply thereof and the nozzle positioned above the switch plate. This allows the grease or lubricant to heated in cold temperatures such that the grease or lubricant is in a flowable state with a viscosity allowing the grease or lubricant to flow from the reservoir to nozzle and be sprayed from the nozzle with the air flow, which for example, may atomize the lubricant passing out the nozzle.

For example, the system comprises two main components: a power unit and applicator unit(s). There may be two applicator units in the system. The power unit generally houses or otherwise supports components such as an air compressor and air tank, active air dryer, air solenoid valves, batteries, a grease pump and grease tank, water pump, water heater, and a generator/AC junction box. There are two applicator units which each comprise a nozzle bar, progressive valve, adjustable alignment nozzles (for example 5+ per Unit), air lines, grease lines, hose exchanges, track mounting brackets, and a removable protective shields.

In one or more embodiments, the system comprises a power unit. The power unit comprises a generator assembly and a pump assembly, which may be coupled to a high output alternator. The power unit further comprises temperature sensors for the enclosure, outside air, applicator air, lubricant and/or a hydraulic oil pump for operational efficiency and adjustment. The temperature sensors may be digital or analog sensors. The assembly may optionally comprise a 24 VDC or 12 VDC power unit.

The assembly may also comprise an electrical panel which comprises one or more programmable system controllers with circuit protection and switches for manual engine control override and a manual start push button with an e-stop push button. These elements may be provided in the power unit housing. Additionally, switches for manual operation of the power unit functions and adjustment of settings are also provided. The switches and push buttons as well as other components may be mounted to DIN rail on the electrical panel.

The assembly may also comprise a programmable controller system. The features of such a controller may include a web-based interface monitoring and diagnostic system and remote firmware update capability. The controller may also have a supply voltage (12 VDC). The controller system may also be a user programmable controller for all functions. The controller may also be a remote monitoring system with a cellular modem. Additionally, the controller may be provided in a housing for or connectable to the power unit that is a rugged enclosure for mobile or stationary environments.

Further, program features for the assembly include custom programs to control the lubrication and heating system and custom programs to control one or more of an embedded program control all functions for lubrication application, system temperature sensors and pressure sensors to maintain enclosure and grease temperatures at or near set points, proximity sensors and remote input to start lubrication sequence; monitor battery voltage to maintain battery charge, manual mode for manual control of system, and/or an automatic electric rail charger.

The power unit also has a lubricant, or grease, pump, tank and associated equipment. For example, the power unit comprises a multi-gallon capacity reservoir for lubricant and electronic level and temperature sensors. The lubricant or grease pump may be an electric driven pump including a custom 24 or 12 VDC electric driven pump.

It is also contemplated that a heated jacketed grease tank may be incorporated into the system. In such an assembly a heated jacket may also be provided to the grease and air lines coupled to main bodies supporting the lubricant delivery nozzles. The system may also be provided with electric, gas, or liquid fuel heating elements and a cold weather air compressor for grease application with dryer.

The air compressor is provided to direct air through the lubricant distribution nozzle. Thus, in one embodiment a combination of air and lubricant is directed through the nozzle. Lubricant is applied to the switch plate with air flow such that air flow forces the lubricant through the nozzle and ensures that the nozzle is cleared with each application of lubricant. The air compressor may be mounted in the power unit with corresponding air reservoir and air dryer.

One or more of the elements described above may be battery powered with rechargeable batteries. The system may also be configured for renewal energy sources for power, such as wind or solar power.

In one or more embodiments, the grease pump may be configured for 3500 PSI output at 700 PSI input pressure and capable of on-demand operation. The assembly may be configured for adjustable hydraulic flow control. The grease pump delivers grease from the reservoir to one or more lubricating nozzles operably connected thereto via flexible hoses. As noted above, air may also be forced through the flexible hoses with the lubricant and/or other fluids (e.g., solvents, detergents) for delivery and lubrication as well as nozzle clearing. It is also contemplated that air may be forced through these lines from the air compressor to the distribution nozzles alone for purposes of clearing the lines and/or nozzles.

Electric and dispensing system plumbing of the assembly comprises high-pressure hoses with water jackets and high-pressure fittings. One in-line high pressure fluid outlet filter. High-pressure hoses for pressure and return lines are provided along with heavy duty air hoses plumbed to an applicator nozzle for delivery or lubricant or grease from the assembly. The assembly may further comprise an electric air compressor with a custom desiccant air dryer The applicator unit may be a linear in-track assembly with optional shield assembly for securing over the track assembly. The linear track has a selected length which may vary depending on the length or type of switch rail arm the track is mounted to. Dimensions of the track may also vary in relation to various other conditions of use and environment of the rail. The location of mounting of the lubrication track may be at or on the switch rail arm. The track assembly supports one or more switch plate lubricant delivery nozzles which are directionally positioned and aimed downwardly or vertically for delivery of lubricant or grease to the switch plate of the rails based on the position of the switch arm. The applicator unit is spaced apart from and operably and fluidically connected to the power unit.

The applicator assembly may be provided with a plurality of mounting brackets for bolting the assembly directly to a switch rail arm. This allows for ease of installation and maintenance. The power unit and control programming allow for alternating switch plate lubrication, which may be based on signals and/or switch discretion for the rail. Alternative mountings may be available providing the nozzles are positioned to direct lubricant to the switch plates.

The applicator unit further may comprise positionally adjustable application nozzles supported by a corresponding main body. The nozzles may be positioned on a bottom surface of the main body and extending downwardly therefrom. The main body is mounted onto aluminum extrusions which are provided with internal hot water flow for heated operation of the nozzles operably secured thereto, and internal return lines for re-heating water. For example, the system comprises a hot water heater allowing for cold weather operation and may also include water jacket hoses for heating the system with hot water from a hot water heater operably connected thereto. The hot water heater may be provided in the power unit as well. The supply hoses and wiring may then also be wrapped with protective insulation for thermal efficiency and safety.

The main body of the applicator unit is also provided with one or more couplings for connecting to heated or jacketed lubricant delivery hoses for receiving lubricant and directing the lubricant to and through the nozzle supported on the main body downwardly to the switch plates.

The system may also support a plurality of main bodies with nozzles thereon such that the main bodies are spaced apart along a length of the track assembly. The positioning of the main bodies may be adjustable so as to align with the switch plates. The nozzles are spaced apart vertically from the switch plate but may be approximately centered over the switch plates. Each main body may have an external surface configured to mate with a surface of the lubrication track assembly opposite the switch arm and may be secured thereto with a fastener, such as a bolt. For example, the track may have one or more channels extending along a length of the track and the main bodies provided with one or more fasteners to couple within the one or more channels.

Figure 3:
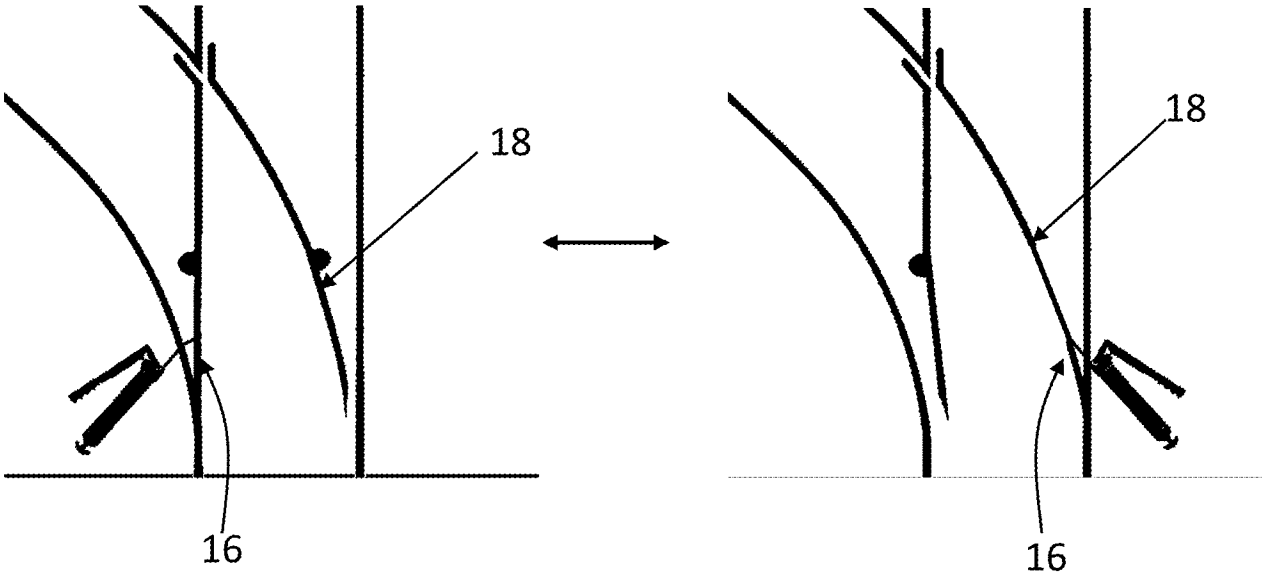
FIG. 3 illustrates the first and second positions of a switch plate for lubrication.

In the embodiment illustrated in FIG. 1-11, the system 10 is an automatic system comprising a power unit 12 and at least one applicator unit 14. As shown in FIG. 3, the system 10 is configured to automatically dispense heated lubricant, or "grease" onto exposed portion(s) 16 of a switch plate 18 which allows for sliding rail spreading of the applied grease across the top of the switch plate 18 and onto the base of the stationary rails 20 when transitioned from position A to position B or from position B to position A.

Figure 4:
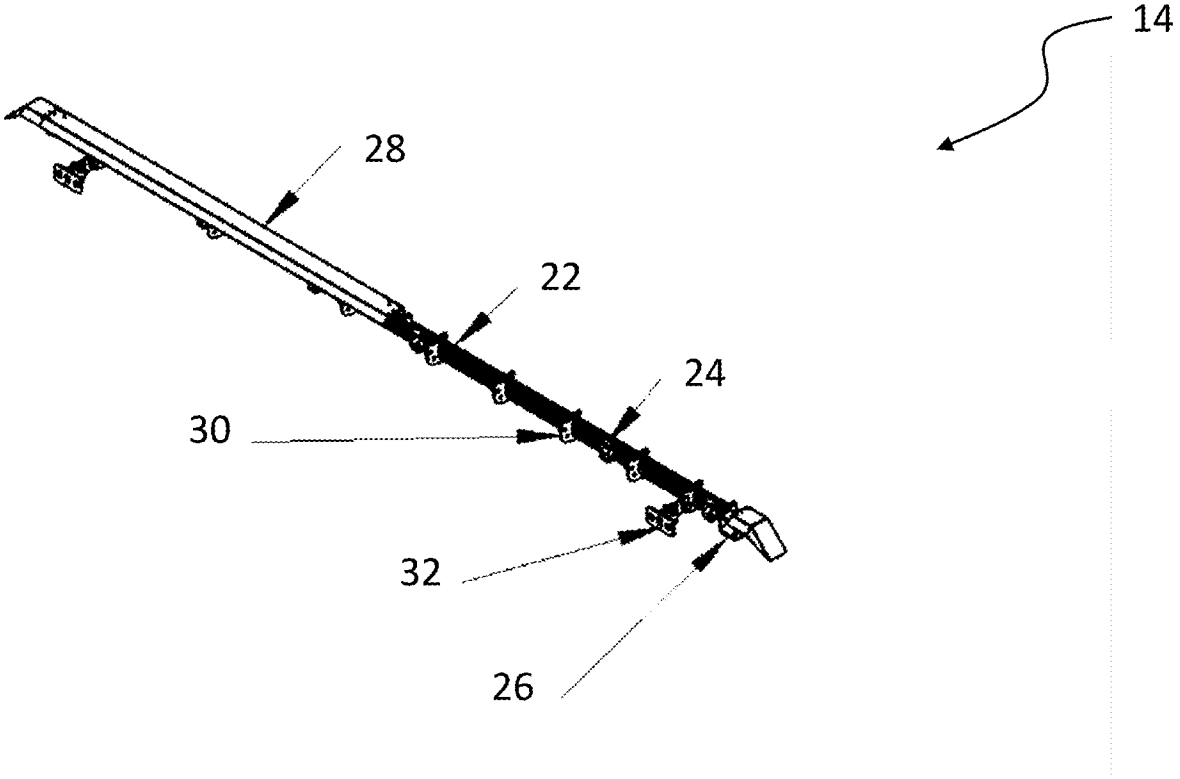
FIG. 4 is a perspective view of an applicator unit assembly with the removable shield removed exposing the unit components.
Figure 5:
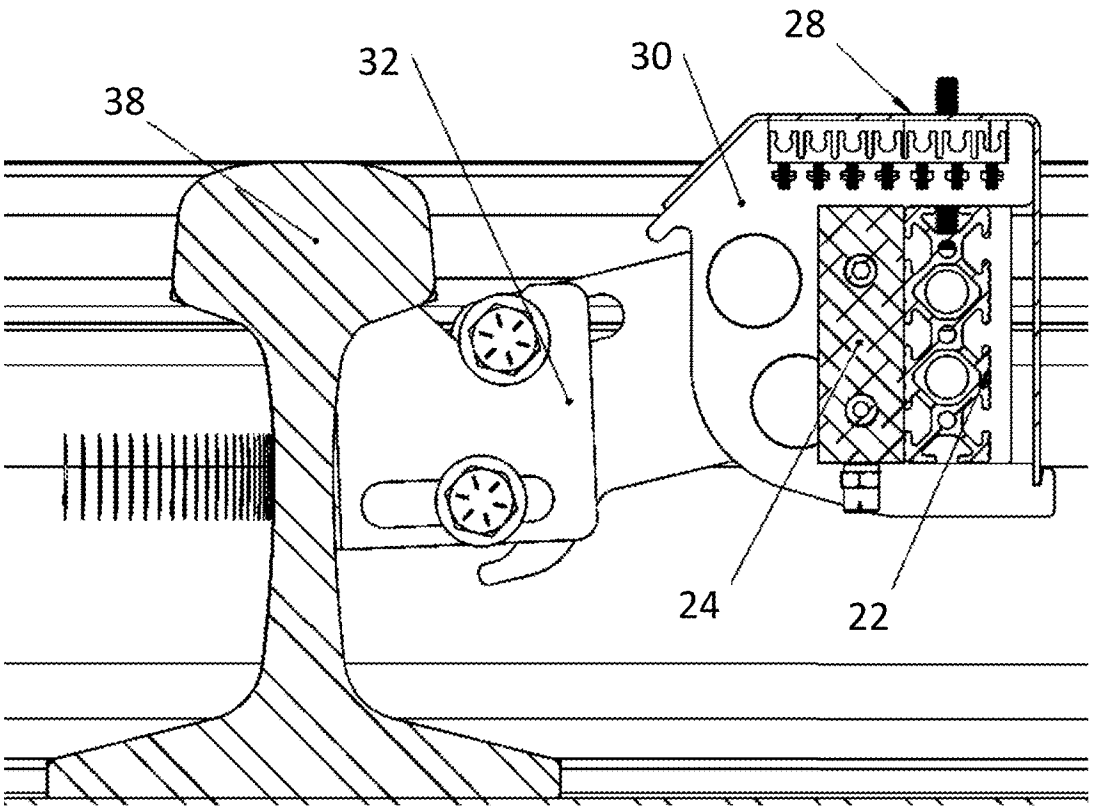
FIG. 5 is a cross section diagram view of the applicator unit.
Figure 6:
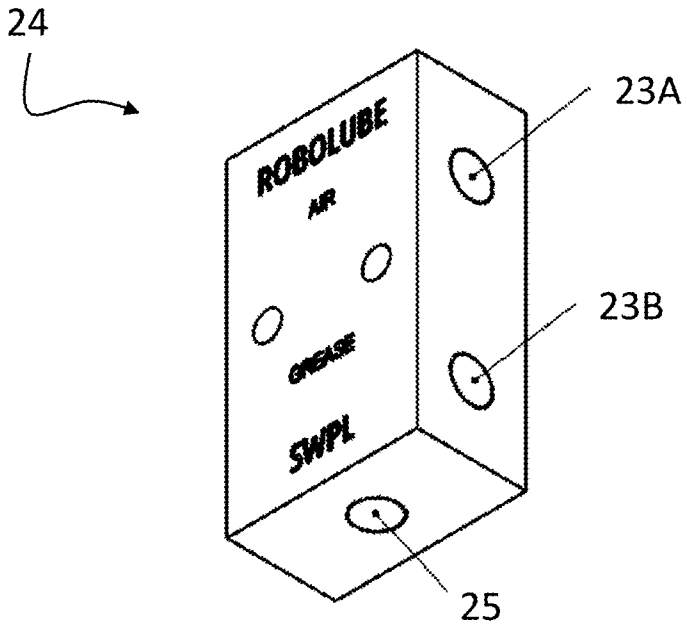
FIG. 6 is a perspective view of a lubrication distribution block.

The applicator unit 14 is shown in further detail in FIGS. 4-6. The applicator unit 14 comprises a nozzle bar 22 which may be a heated nozzle bar 22. One or more adjustable nozzle blocks 24 are spaced apart and mounted to the nozzle bar 22 in an operable manner. The blocks 24 are positionally adjustable on the length of the nozzle bar 22. The applicator unit 14 is further provided with a mechanism for coupling to the power unit 12. In the embodiment illustrated, the applicator unit 14 comprises a hose exchange 26 to accomplish fluid connection with the power unit 12. The hose exchange 26 allows for adding/removing lubricant lines from inside the water lines.

The applicator unit 14 may further comprise one or more removable protection shields 28 or covers for the nozzle bar 22. One or more shield support and hose management brackets 30 are provided on the nozzle bar 22 for connection of the shield 28 and/or mounting and organization of one or more hoses for delivery of air, lubricant, or heat to the applicator unit 14.

The nozzle blocks 24, also illustrated in FIG. 6, are configured to receive a metered volume of lubricant pumped into all nozzle blocks 24 through lubricant inlet 23B once per cycle in one embodiment of use of the system 10. Lubricant is then stored in the nozzle block 24 until an application is required. Air is provided to the block 24 through inlet 23A. When required, the system 10 controller activates air solenoid valves V1-V9 one at a time that correspond to an outlet 25 which comprises a nozzle positioned to face the exposed plate side 18 of the switch 16. The nozzle blocks 24 are positionally adjustable along the length of the nozzle bar 22. The aim of the nozzle can also be adjusted as well, for example, via adjustable modular hose and nozzle tip.

The applicator unit 14 may also be provided with mounting brackets 32 that are configured for universal mounting on rails 38 and allowing for mounting/removal of the unit 14 to/from the brackets 32 without the need for tools.

Figure 7:
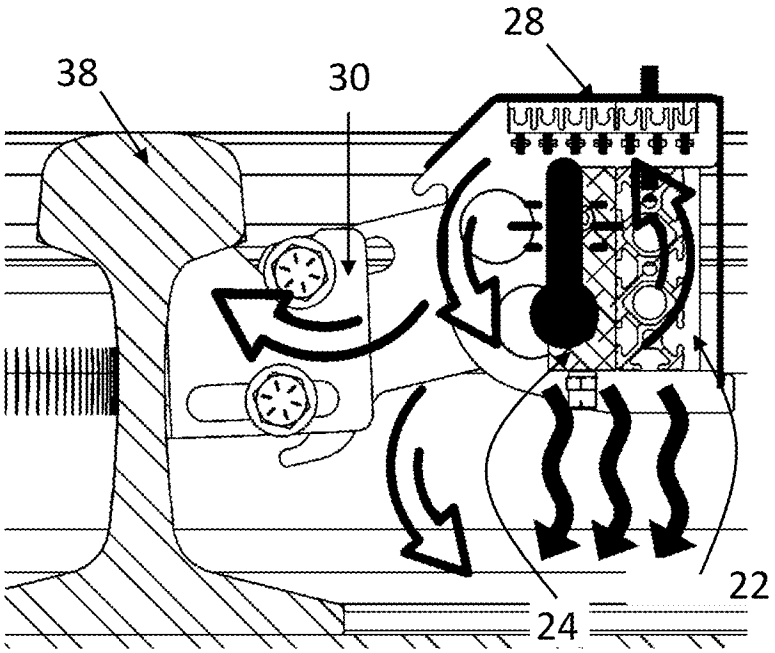
FIG. 7 illustrates a heating design for the lubrication distribution block.

As further illustrated in FIG. 7, the heated nozzle bar 22 supplies a level of radiant heat that is transferred to the rail 38 and switch plates 16. Convection occurs inside the shield 28 to assist in transferring heat to exterior components.

Figure 8:
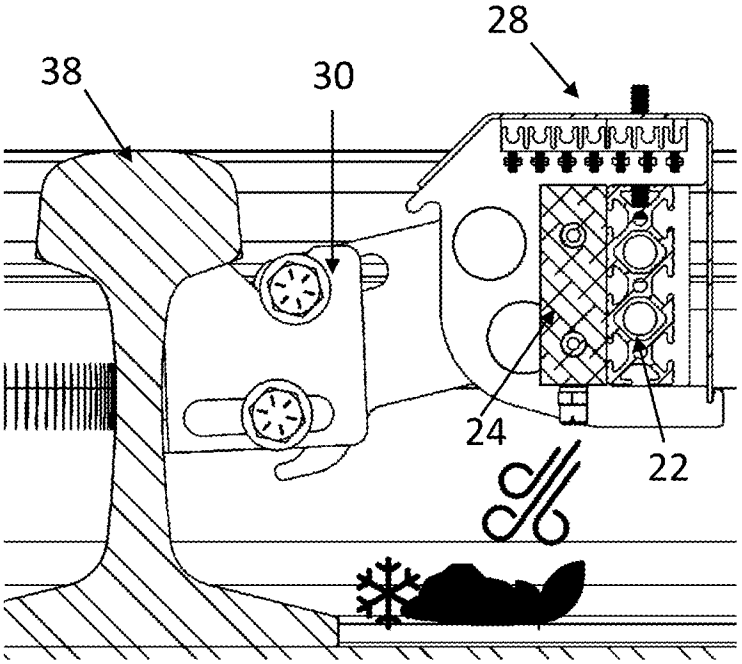
FIG. 8 illustrates a debris and snow removal assembly for the system.

As further illustrated in FIG. 8, when the system 10 applies lubrication, the air used to blow the grease out of the nozzle of the nozzle block 24 which also helps to clear snow and debris off the top surface of the switch plate 16 further enhancing the effectiveness of the system 10 in terms of component wear and potential corrosion.

Figure 9:
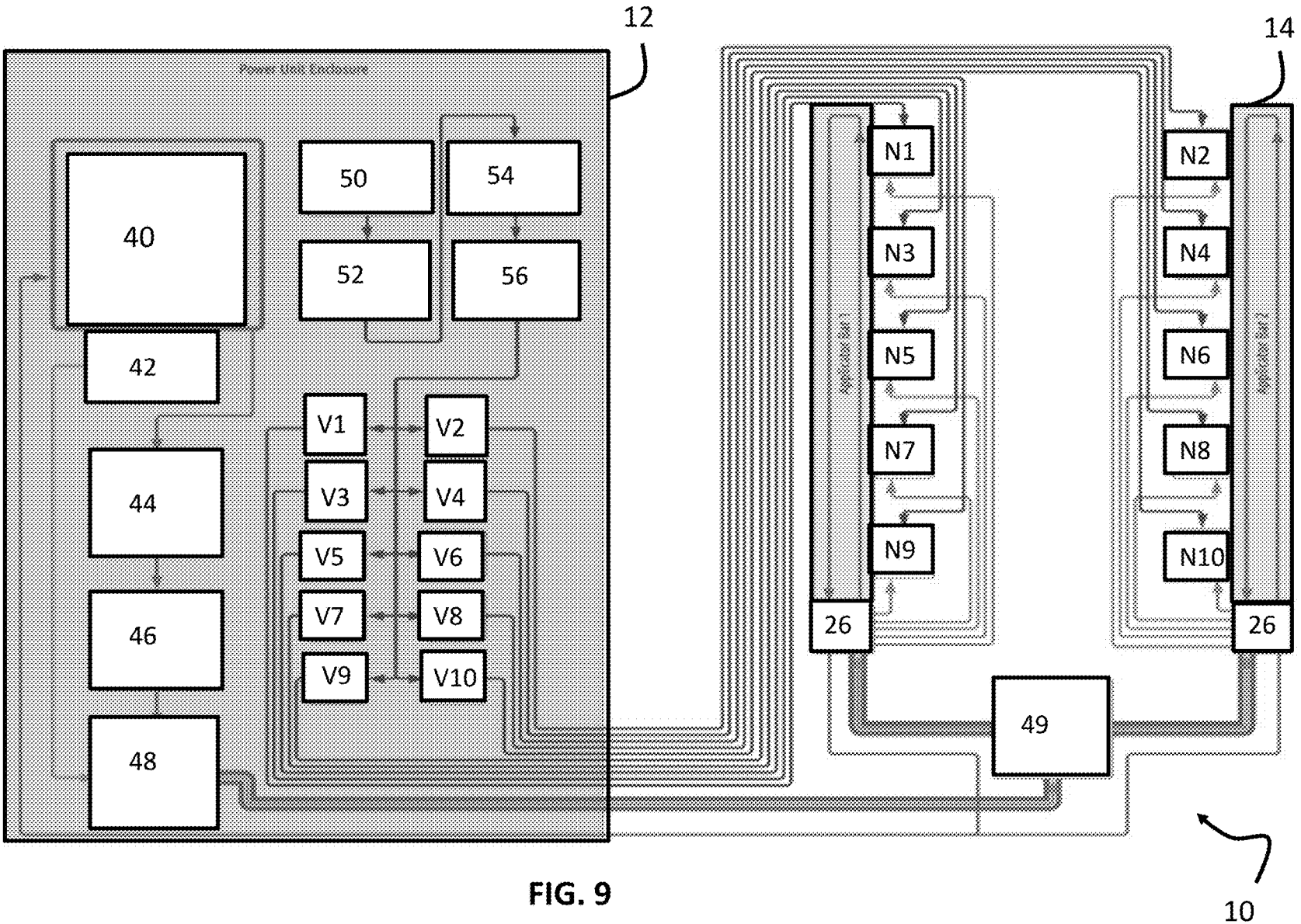
FIG. 9 is a fluid schematic for the system.

The power unit 12 and applicator unit(s) 14 are operably and fluidically connected, meaning the power unit 12 controls application of lubricant through the applicator unit(s) 14 and/or provides signals for actuation. The power unit 12 and applicator unit(s) 14 may be wired or in wireless connection for communication and actuation of distribution. Fluidically, the power unit 12 is connected to the applicator unit(s) 14 via one or more hoses and/or tubes for providing the air flow, lubricant and heating components to the applicator unit(s) 14. As shown in FIG. 9, the power unit 12 is an enclosure housing for example a lubricant tank 40, a lubricant pump 42, water pump 44, water heater 46 and hose exchange 48. The hose exchange 48 directs one or more hoses to a SSV valve and water block 49, wherein hoses then are directed to respective hose exchange(s) 26 on the applicator unit(s) 14. An air compressor 50 and active air dryer 52, as well as air tank 54 and air flow regulator 54 are housed and controlled in the power unit 12. Connection of the power unit 12 to two applicator units 14 for both exposed sides of the switch plate 18 are shown in FIG. 9.

Figure 10:
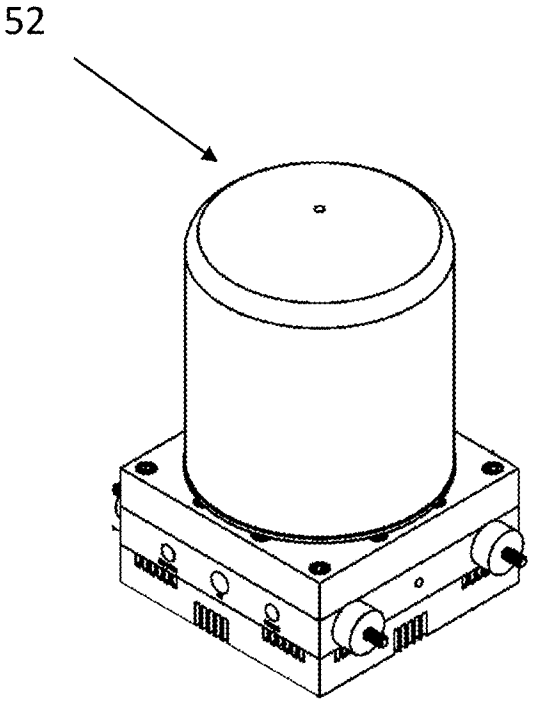
FIG. 10 is a perspective of an active air drier for the system.

FIG. 10 is an additional view of the active air dryer 52. When the air compressor turns on, Peltier modules cool the surface with the incoming air flows against the surfaces to increase condensation on aforementioned surface. Heat generated by a hot side of Peltier modules is dissipated via fans and a heatsink on a bottom of the power unit 12. When the air compressor 50 turns off, a purge valve opens and allows air to flow backwards through a desiccant, blowing out excess moisture into the desiccant and blowing out the condensation accumulated on the intake surface.

Although the present disclosure has been described with reference to preferred embodiments, workers skilled in the art will recognize that changes may be made in form and detail without departing from the spirit and scope of the disclosure.

What is claimed:

1. An automatic rail switch plate lubrication system comprising:

a power unit enclosure; and an applicator unit secured to a rail switch arm, wherein the applicator unit comprises:

a nozzle bar extending a length of the applicator unit;

a plurality of adjustable lubricant application blocks, each block comprising a nozzle and wherein the plurality of adjustable lubricant application blocks are spaced apart along the nozzle bar and positionally adjustable there along;

a bracket configured for mounting the applicator unit on the rail switch arm such that the nozzle of each block is provided over a switch plate; and an exchange point for fluidically coupling to a lubricant delivery hose connected to a reservoir holding lubricant to the nozzle bar for delivery of the lubricant to the each of the plurality of adjustable lubricant application blocks, and wherein the nozzle bar is heated for distribution of heated lubricant to an exposed portion of the switch plate.

2. The system of claim 1, wherein the applicator unit is mounted on a section of rail proximate the switch plate of the rail and wherein the power unit is spaced therefrom.

3. The system of claim 2 wherein a high pressure positive displacement pump delivers lubricant from the reservoir to one or more lubricant application blocks operably connected thereto via flexible hoses.

4. The system of claim 3 wherein an air compressor delivers air from an air reservoir to the one or more lubricant application blocks operably connected thereto wherein the air is delivered to and through the nozzle with lubricant.

5. The system of claim 1, wherein the plurality of lubricant application blocks are configured to store a metered volume of lubricant received from a grease pump until the lubricant is discharged from the nozzle of the lubricant application block.

6. The system of claim 1 and further comprising an air solenoid valve corresponding to a nozzle on an exposed side of the switch plate and wherein the valves are actuated for lubrication.

7. The system of claim 6 wherein an air flow is provided with the lubricant delivered to and through the nozzles.

8. The system of claim 1 wherein the power unit houses one or more of an air compressor, air tank, lubricant pump, lubricant reservoir, water pump, water heater and power source.

9. The system of claim 1 wherein the nozzle bar further comprises integral hot water and return lines for heating the lubricant and/or the lubricant application blocks on the applicator unit.

10. The system of claim 1 wherein the applicator unit further comprises a removable protective shield for the nozzle bar.

11. The system of claim 1 and further comprising one or more temperature sensors for the power unit, enclosure, outside air, applicator air, lubricant or combinations thereof.

12. The system of claim 1 wherein the system is an electrically controlled system comprising one or more rechargeable batteries for power.

* * * * *